US006484966B1

(12) United States Patent
Steiner et al.

(10) Patent No.: US 6,484,966 B1
(45) Date of Patent: Nov. 26, 2002

(54) TARGET-DETECTION DEVICE FOR A MISSILE SYSTEM

(75) Inventors: Jurgen Steiner, Ohobrunn (DE); Güunther Riedl, Egling (DE)

(73) Assignee: LFK-Lenkflugkorpesysteme GmbH, Munich (DE)

( * ) Notice: Subject to any disclaimer, the term of this patent is extended or adjusted under 35 U.S.C. 154(b) by 0 days.

(21) Appl. No.: 09/486,175

(22) PCT Filed: Aug. 1, 1998

(86) PCT No.: PCT/DE98/02193

§ 371 (c)(1),
(2), (4) Date: Apr. 20, 2000

(87) PCT Pub. No.: WO99/10701

PCT Pub. Date: Mar. 4, 1999

(30) Foreign Application Priority Data

Aug. 21, 1997 (DE) ..... 197 36 305

(51) Int. Cl.[7] ..... F41G 7/20; F41G 9/00

(52) U.S. Cl. ..... 244/3.11; 244/3.1; 244/3.15; 244/3.16

(58) Field of Search ..... 342/351; 244/3.1–3.22

(56) References Cited

U.S. PATENT DOCUMENTS

| | | | | |
|---|---|---|---|---|
| 3,841,585 A | * | 10/1974 | Evers-Euterneck | 244/3.15 |
| 3,974,985 A | * | 8/1976 | Campbell et al. | 244/3.16 |
| 4,087,061 A | * | 5/1978 | Burt | 244/3.16 |
| 4,324,491 A | | 4/1982 | Heuber | |
| 5,964,432 A | * | 10/1999 | Obkircher | 244/3.16 |

FOREIGN PATENT DOCUMENTS

| | | |
|---|---|---|
| DE | 3327384 | 2/1985 |
| EP | 0260191 | 3/1988 |
| WO | 9726550 | 7/1997 |

* cited by examiner

*Primary Examiner*—Bernarr E. Gregory
(74) *Attorney, Agent, or Firm*—Ladas & Parry

(57) ABSTRACT

The invention relates to a target-detection and target-alignment device for a missile system whose field of view is expanded by a wide-angle lens system, which does not contain any optical components which must be additionally moved, and which is equipped with an integrated system for correction of homogeneity of the ambient conditions. Two radiometers or photometers are connected to two emission surfaces positioned on opposite sides of the image of the field of view to adjust the angle of the target detector to compensate for mismatch of the output signals of the emission surfaces.

5 Claims, 1 Drawing Sheet

TARGET-DETECTION DEVICE FOR A MISSILE SYSTEM

FIELD OF THE INVENTION

The invention relates to a target-detection device for a missile system such as a shoulder launched missile system.

The invention relates, in particular, to such a missile detection system in which an imaging sensor of a target detector on the missile sends an image to a wide angle lens system.

BACKGROUND

Modern operator controlled missile systems, such as shoulder launched missile systems are generally aimed at a target by the operator by means of optical devices containing simple or complex reflective elements. Detection and assignment of the target in such cases is achieved either in a simple way by observers with binoculars or by guidance systems, which receive their information from sensors which are not part of the missile or its launching system.

Also known are IR thermal imaging systems for target acquisition by an observer (without self-guidance by the missile system) for example, by using the imaging sensor of the missile itself for the imaging of the target. In such embodiments, the imaging missile sensor is used for target detection and acquisition in combination with a wide-angle lens adapter, in order to broaden the normally narrow visual field provided by the imaging sensor on the missile.

SUMMARY OF THE INVENTION

An object of the present invention is to provide a thermal imaging system of the above type in which the wide-angle visual field of the wide-angle adapter is adjusted without any movable optical components to correct for non-uniform ambient conditions.

This object is achieved according to the invention by providing radiation detection means for detecting ambient atmospheric conditions and for adjusting emissions on both sides of the emission image produced by the wide-angle adapter to compensate for non-uniformity in the ambient atmosphere.

In further accordance with the invention, the radiation detection means comprises radiation sensors for detecting radiation differences in the ambient atmosphere, for example, by aiming one radiation sensor towards the sky and another radiation sensor towards the ground and supplying emission from the radiation sensors to two auxiliary emission members having emission surfaces located on opposite sides of an optical member which produces the image in the wide-angle lens system.

DETAILED DESCRIPTION

Figures 1, 2:
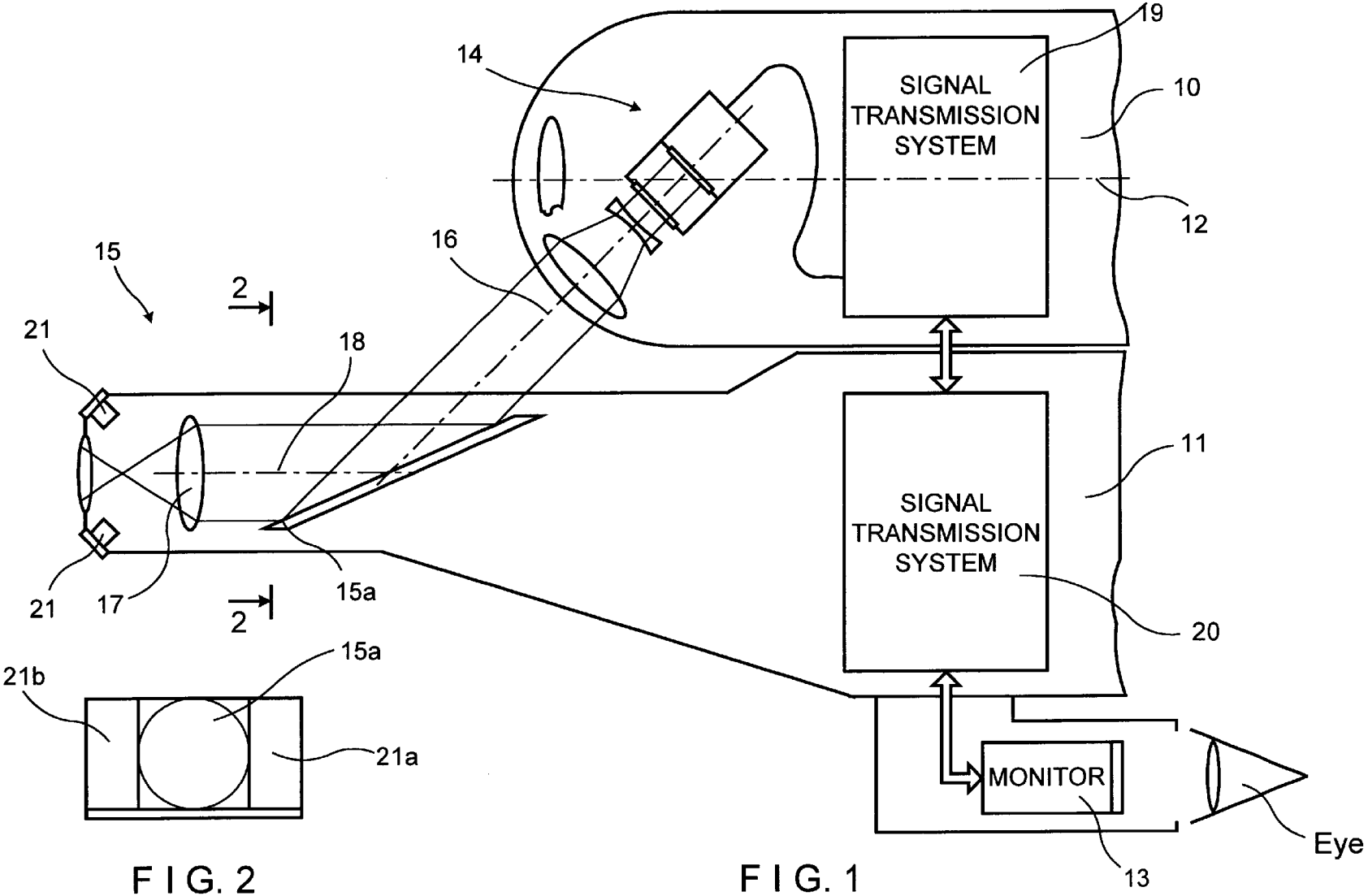
FIG. 1 is a diagrammatic illustration of an embodiment of the invention.
FIG. 2 is a sectional view taken on line 2—2 in FIG. 1.

Referring to the drawing, therein is shown a missile 10, for example, a shoulder launched missile, having a target seeker head 14. The seeker head 14 has an imaging system which receives an image in front of the missile 10 and transmits the image along an optical axis 16 obliquely inclined with respect to an axis 12 of the missile. The seeker head is mounted for swiveling movement but during imaging it is locked in place. Mounted on a missile launcher 11 of the weapon system is a mirror or prism system 15. The image transmitted along optical axis 16 from target seeker head 14 falls on the center of an a focal lens system 17, which in, conventional manner, widens the visual field of the image from the target seeker head, the lens system 17 being disposed on an optical axis 18 which is substantially parallel to missile axis 12.

The image thus formed is fed to an appropriate signal-transmission system 19, 20 and in turn to a monitor 13 or similar display device which can be viewed by an operator. The monitor 13 shows the operator the target and a mark and the operator aligns the target with the mark, whereupon the target seeker head swivels toward the mark automatically or under manual control of the operator so that head 14 locks onto the target.

The device described hereinabove is so designed that the image of the target seeker head 14 without adaptor lens 15 as well as the lock-on operation itself can be simultaneously observed by the operator on the monitor 13.

In a particular embodiment, it is possible to achieve the aforesaid operation semiautomatically or fully automatically by means of an electronic image-processing system.

Since the target seeker head 14 of the described type often requires correction for lack of homogeneity (non-uniformity) of the ambient atmosphere, the invention provides auxiliary surfaces 21*a*, 21*b* with well-defined emission for compensating for non-homogeneity. In most cases, two such surfaces 21*a*, 21*b* are sufficient and they are disposed next to the mirror or prism 15*a* of the mirror or prism system 15 on opposite sides thereof. Optical axis 12 of head 14 is then aligned taking into account these auxiliary surfaces 21*a*, 21*b*, in order to achieve the desired homogeneity correction. Adjustment of the emission of auxiliary surfaces 21*a*, 21*b* with respect to the ambient conditions is performed advantageously according to the output signals of one or more radiation sensors 21, such as radiometers or photometers, which receive the ambient radiation. In order to maximize differences of ambient radiation, at least one of the sensors 21 is aimed at the ground and another at the sky.

Although the invention is disclosed with reference to particular embodiments thereof, it will become apparent to those skilled in the art that numerous modifications and variations can be made which will fall within the scope and spirit of the invention as defined by the attached claims.

What is claimed is:

1. A target detection device for a missile system comprising:

an adjustable target seeker head mounted on a missile, said target seeker head including an imaging sensor producing an image of a target along an axis disposed obliquely with respect to an axis of the missile, a wide angle lens system including an afocal lens system positioned to receive the image from the target seeker head to produce a wide angle image thereof, said afocal lens system having an optical axis substantially parallel to the axis of the missile, an external monitor for target marking and tracking, a signal transmission system connected to the target seeker head to transmit to the monitor said wide angle image, radiation sensor means for sensing ambient radiation, and two auxiliary surfaces adjacent to and on opposite sides of said a focal lens system, said auxiliary emission surfaces receiving radiation signals from said radiation sensor means to correct non-uniformity of ambient radiation.

2. A device as claimed in claim 1, wherein said wide angle lens system includes a mirror or prism and said auxiliary surfaces are fixed on opposite sides of said mirror or prism.

3. A device as claimed in claim 1, wherein said signal transmission system produces on said monitor the image produced by the target seeker head without wide angle image enhancement simultaneously with said wide angle image.

4. A device as claimed in claim 1, wherein said missile system includes a missile launcher, said wide angle lens system being secured to said launcher.

5. A device as claimed in claim 1, wherein said radiation sensor means comprises two radiometers or photometers, one of which is aimed upward to the sky and the other of which is aimed downward to the ground.

* * * * *